US006616071B2

(12) United States Patent
Kitamura et al.

(10) Patent No.: US 6,616,071 B2
(45) Date of Patent: Sep. 9, 2003

(54) FUEL INJECTION VALVE

(75) Inventors: Koji Kitamura, Miyagi (JP); Akira Arioka, Miyagi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/983,545

(22) Filed: Oct. 24, 2001

(65) Prior Publication Data

US 2002/0063175 A1 May 30, 2002

(30) Foreign Application Priority Data

Oct. 24, 2000 (JP) ..... 2000-324500

(51) Int. Cl.[7] ..... F02M 61/00

(52) U.S. Cl. ..... 239/533.12; 239/533.14; 239/585.1; 239/596; 239/900

(58) Field of Search ..... 239/533.12, 533.14, 239/585.1, 585.2, 585.3, 585.4, 585.5, 596, 900

(56) References Cited

U.S. PATENT DOCUMENTS 5,762,272 A * 6/1998 Tani et al. ..... 239/585.4
6,070,812 A * 6/2000 Tani et al. ..... 239/533.12
6,089,476 A * 7/2000 Sugimoto et al. ..... 239/533.12
6,161,780 A * 12/2000 Sugimoto et al. ..... 239/533.12
6,186,418 B1 * 2/2001 Tani ..... 239/533.12

FOREIGN PATENT DOCUMENTS

JP 2000-97129 4/2000

* cited by examiner

*Primary Examiner*—Robin O. Evans
(74) *Attorney, Agent, or Firm*—Arent Fox Kintner Plotkin & Kahn, PLLC

(57) ABSTRACT

A fuel injection valve includes a valve seat member having a valve bore, and an injector plate coupled to an outer end face of the valve seat member. A fuel diffusion chamber is defined between the valve seat member and the injector plate. The injector plate is provided with a plurality of fuel injection bores which are parted on a plane including an axis of the valve bore into primary and secondary groups for injecting fuel toward primary and secondary intake ports. When a direction of arrangement of the primary and secondary intake ports is represented by X, and a direction perpendicular to the direction of arrangement is represented by Y, the fuel injection bores of the primary and secondary groups are formed so that they are inclined to a side opposite from the axis of the valve bore only in a direction X toward a downstream side.

4 Claims, 8 Drawing Sheets

FUEL INJECTION VALVE

BACKGROUND OF THE INVENTION

1. Field of the Invention

The present invention relates to a solenoid-type fuel injection valve mainly for use in a fuel supply system in an internal combustion engine, and particularly to an improvement of a solenoid-type fuel injection valve comprising a valve seat member having a valve seat and a valve bore provided through a center portion of the valve seat, a valve stem for opening and closing the valve bore by cooperation with the valve seat, an injector plate coupled to an outer end face of the valve seat member and having a plurality of fuel injection bores disposed around an axis of the valve bore, and a fuel diffusion chamber which is defined between the valve seat member and the injector plate and which is faced by the valve bore and all of the fuel injection bores, the plurality of fuel injection bores being parted on a plane including the axis of the valve bore into primary and secondary groups for injecting fuel toward a pair of primary and secondary intake ports, respectively.

2. Description of the Related Art

Such a solenoid-type fuel injection valve is already known, for example, as disclosed in Japanese Patent Application Laid-open No. 2000-97129.

In such known fuel injection valve, the fuel injection bores are provided in the injection plate, so that they are inclined to become farther radially from the axis of the valve bore at a more downstream location, and the angles of fuel spray foams formed by the fuel flows injected from all the fuel injection bores are set depending on such inclination angles.

When the fuel injection bores are provided in the injection plate, so that they are inclined to become farther radially from the axis of the valve bore at the more downstream location, the directions of inclination of the fuel injection bores are different in two directions (a direction of arrangement of the pair of intake ports and a direction perpendicular to the direction of arrangement). For this reason, it is not easy to make the fuel injection bores and hence, it is extremely difficult to provide a fuel spray foam formed by the fuel injected from each of the fuel injection bores of the primary and secondary groups, as desired.

SUMMARY OF THE INVENTION

Accordingly, it is an object of the present invention to provide a fuel injection valve designed so that a fuel spray foam formed by the fuel injected from each of the fuel injection bores of the primary and secondary groups can be provided easily as desired, while facilitating the formation of the fuel injection bores of the primary and secondary groups.

To achieve the above object, according to a first aspect and feature of the present invention, there is provided a solenoid-type fuel injection valve comprising a valve seat member having a valve seat and a valve bore provided through a center portion of the valve seat, a valve stem for opening and closing the valve bore by cooperation with the valve seat, an injector plate coupled to an outer end face of the valve seat member and having a plurality of fuel injection bores disposed around an axis of the valve bore, and a fuel diffusion chamber which is defined between the valve seat member and the injector plate and which is faced by the valve bore and all of the fuel injection bores, the plurality of fuel injection bores being parted on a plane including the axis of the valve bore into a primary group of fuel injection bores and a secondary group of fuel injection bores for injecting fuel toward a pair of primary and secondary intake ports, respectively, wherein the fuel injection bores of the primary group are formed so that they are inclined to a side opposite an away from the axis of the valve bore only in a direction X toward a downstream side, and the fuel injection bores of the secondary group are formed so that they are inclined to a side opposite and away from the axis of the valve bore only in the direction X toward the downstream side, wherein the direction X represents a direction of arrangement of the primary and secondary ports in the internal combustion engine, and a direction Y represents a direction perpendicular to the direction of arrangement.

With the first feature, the fuel injection bores of the primary and secondary groups are angled only in the direction X to provide spreading angles to primary and secondary fuel spray foams formed by the fuel flows injected from the primary and secondary fuel injection bores with respect to the axis of the valve bore, and the spreading angles of the primary and secondary other spray foams in the directions X and Y are determined depending on the axis distances between the fuel injection bores and the valve bore. More specifically, the angle of inclination of the axis of the valve bore is zero in the direction Y and hence, each of the fuel injection bores can be formed easily at a desired inclination angle in the injector plate by pressing or by drilling, only by inclining the injection plate and a tool relative to each other in the direction Y. Therefore, it is possible to easily provide the primary and secondary fuel spray foams formed by the fuel flows injected from the fuel injection bores of the primary and second groups, as desired, while facilitating the formation of the fuel injection bores of the primary and secondary groups.

According to a second aspect and feature of the present invention, in addition to the first feature, the fuel injection bores of the primary group are sub-classified into a primary inner group of fuel injection bores, and a primary outer group of fuel injection bores disposed on opposite sides of the fuel injection bores of the primary inner group in the direction Y at locations where an axis distance between the fuel injection bore of the primary outer group and the valve bore is smaller than that between the fuel injection bore of the primary inner group and the valve bore, and the fuel injection bores of the secondary group are sub-classified into a secondary inner group of fuel injection bores, and a secondary outer group of fuel injection bores disposed on opposite sides of the fuel injection bores of the secondary inner group in the direction Y at locations where an axis distance between the fuel injection bore of the secondary outer group and the valve bore is smaller than that between the fuel injection bore of the secondary inner group and the valve bore.

With the second feature, the spreading angles of primary and secondary fuel spray foams formed by the fuel flows injected from the fuel injection bores of the primary and secondary groups with respect to the axis of the valve bore are determined by the axis distances R between the fuel injection bores of the primary and secondary inner groups and the valve bore, and the angle of inclination of the fuel injection bores with respect to the axis of the valve bore. The spreading angles of the primary and secondary fuel spray foams in the direction X are determined by the axis distance between the fuel injection bores of the primary and second inner groups as well as the primary and second outer groups. Further, the spreading angles of the primary and secondary fuel spray foams in the direction Y are determined by the axis distance between the fuel injection bores located on the outermost side in the direction Y and the valve bore. Therefore, the number of factors for forming the primary and secondary fuel spray foams is reduced, and it is easy to form the primary and secondary fuel spray foams.

According to a third aspect and feature of the present invention, in addition to the second feature, the fuel injection bores of at least one of the primary and secondary outer groups are formed at a diameter smaller than that of the fuel injection bores of the corresponding inner group.

With the third feature, the spreading of tip end of the fuel flow injected from each of the outer fuel injection bores can be suppressed to a small extent by setting the diameter of each of the outer fuel injection bores at a small value, and hence, the spreading angles of the corresponding primary and secondary spray foams in the direction Y can be defined distinctly, thereby preventing the deposition of the injected fuel to a partition wall between the primary and secondary intake ports in the internal combustion engine to the utmost.

According to a fourth aspect and feature of the present invention, in addition to any of the first to third features, the total of cross-sectional areas of the fuel injection bores of the primary group is set larger than that of cross-sectional areas of the fuel injection bores of the secondary group.

With the fourth feature, the amount of fuel injected from the fuel injection bores of the primary group is larger than that of fuel injected from the fuel injection bores of the secondary group, and thus, in the internal combustion engine, it is possible to exhibit a fuel-dispensing characteristic suitable for the low-speed operational state in which the amount of gas drawn in the primary intake port is larger than that in the secondary intake port. This can contributes to an enhancement, particularly, in performance of the low-speed operation of a higher use frequency.

According to a fifth aspect and feature of the present invention, in addition to any of the first to fourth features, the relationship between the thickness t of the injector plate and the minimum diameter d of the fuel injection bores of the primary and secondary groups is set at $t/d<1$.

With the fifth feature, the atomization of the fuel injected from each of the fuel injection bores can be promoted, while reducing the function of restricting the direction of the fuel injected from each of the fuel injection bores. The setting of the spreading angles of the fuel spray foams depending on the axis distances R between the valve bore and the fuel injection bores can be achieved further easily and properly by reducing the function of restricting the direction of the fuel injected from each of the fuel injection bores. Thus, it is possible to achieve the proper setting of the spreading angles of the fuel spray foams and the promotion of the atomization of the injected fuel simultaneously.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment of the present invention with reference to the accompanying drawings.

Figure 1:
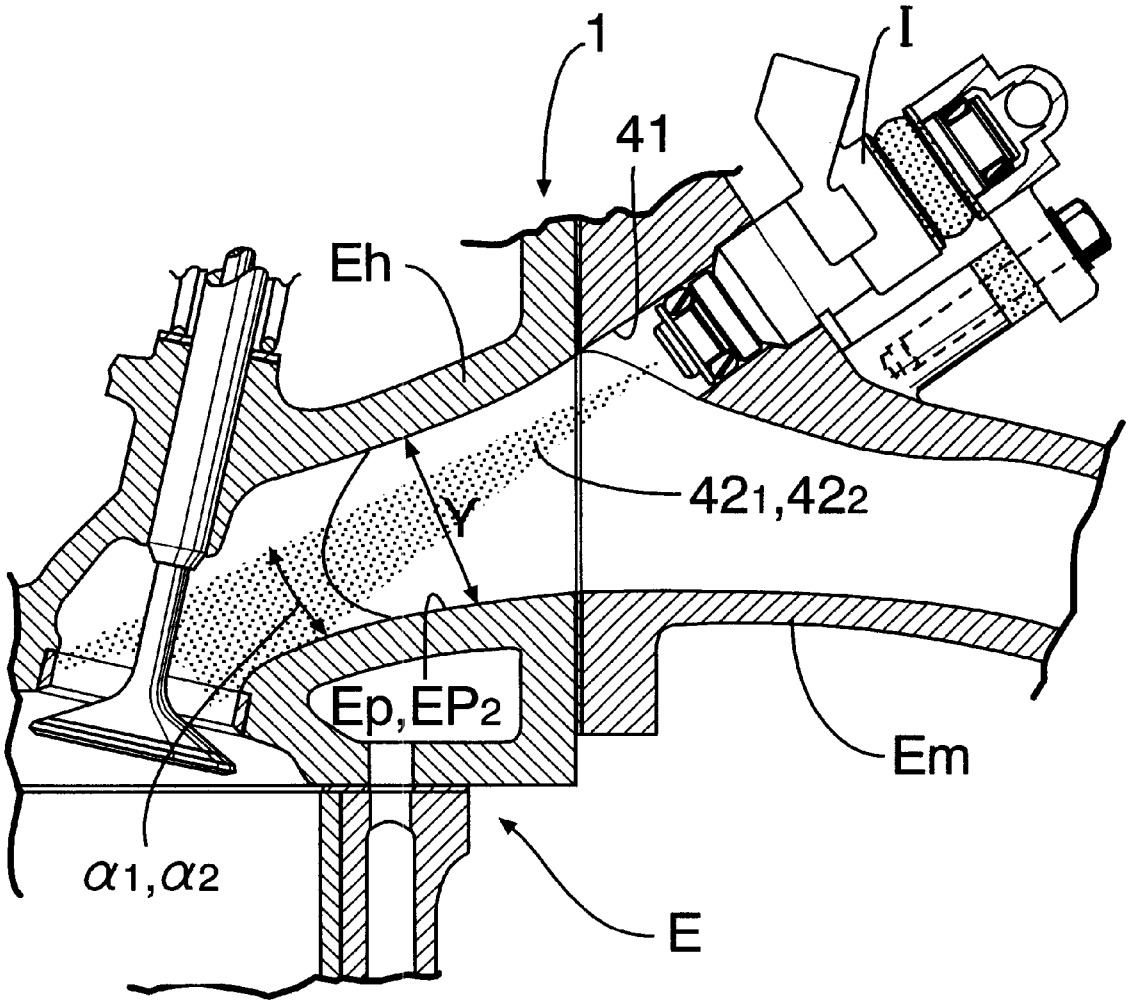
FIG. 1 is a vertical sectional view of an essential portion of an internal combustion engine provided with a solenoid-type fuel injection valve according to the present invention.
Figure 2:
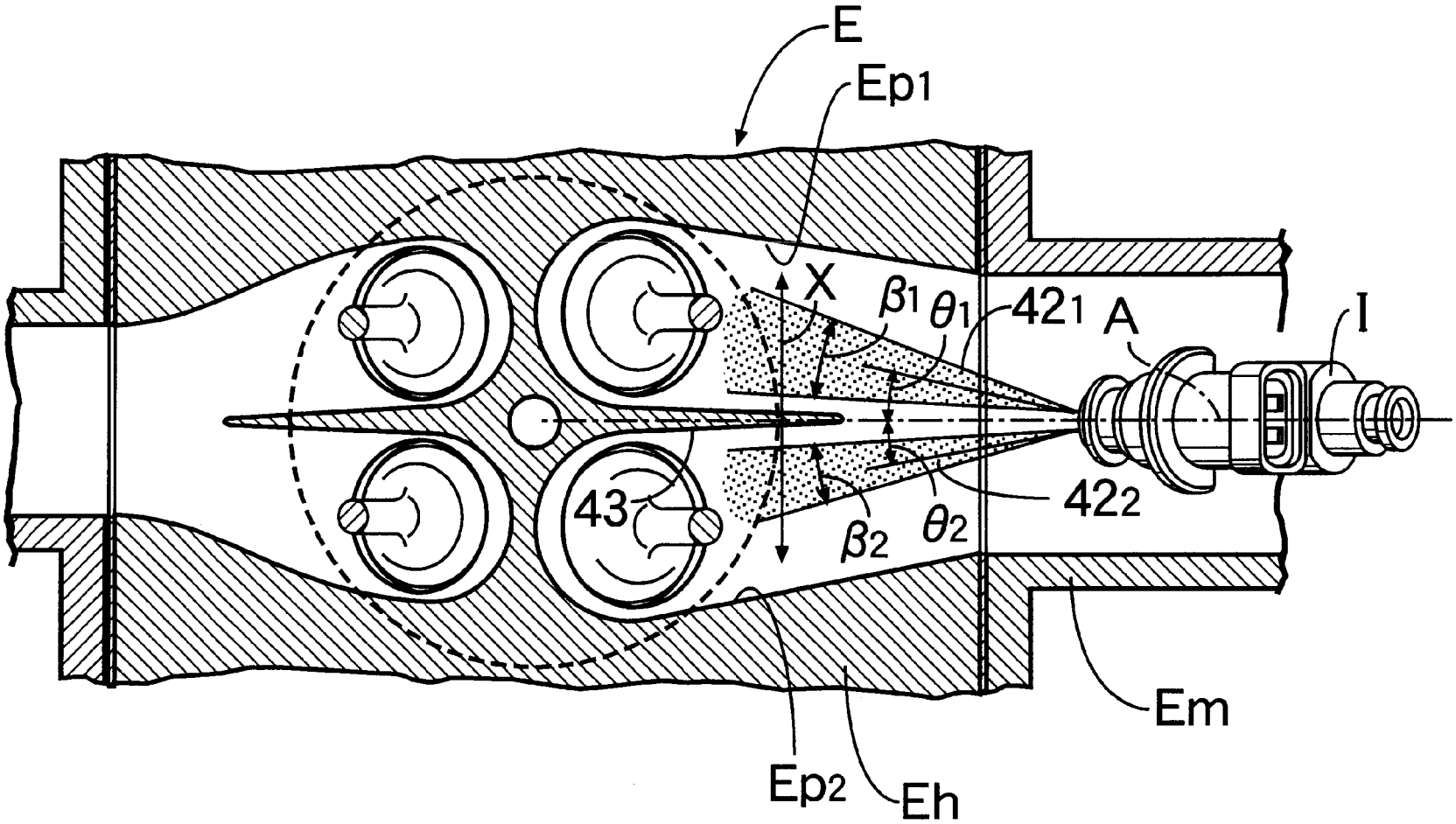
FIG. 2 is a cross-sectional plan view of the essential portion of an internal combustion engine.

Referring first to FIGS. 1 and 2, a cylinder head Eh of an internal combustion engine E includes primary and secondary intake ports $Ep_1$ and $Ep_2$ arranged with a partition wall 43 interposed therebetween in correspondence to one cylinder. An intake manifold Em is coupled to one side of the cylinder head Eh and has a common intake passage communicating with the intake ports $Ep_1$ and $Ep_2$. A solenoid-type fuel injection valve I according to the present invention is mounted in the intake manifold Em and adapted to form primary and secondary fuel spray foams $\mathbf{42}_1$ and $\mathbf{42}_2$ flowing toward outlets of the primary and secondary intake ports $Ep_1$ and $Ep_2$ during injection of fuel. A direction of arrangement of the primary and secondary intake ports $Ep_1$ and $Ep_2$ is represented by X, and a direction perpendicular to the direction of arrangement is represented by Y.

Figure 3:
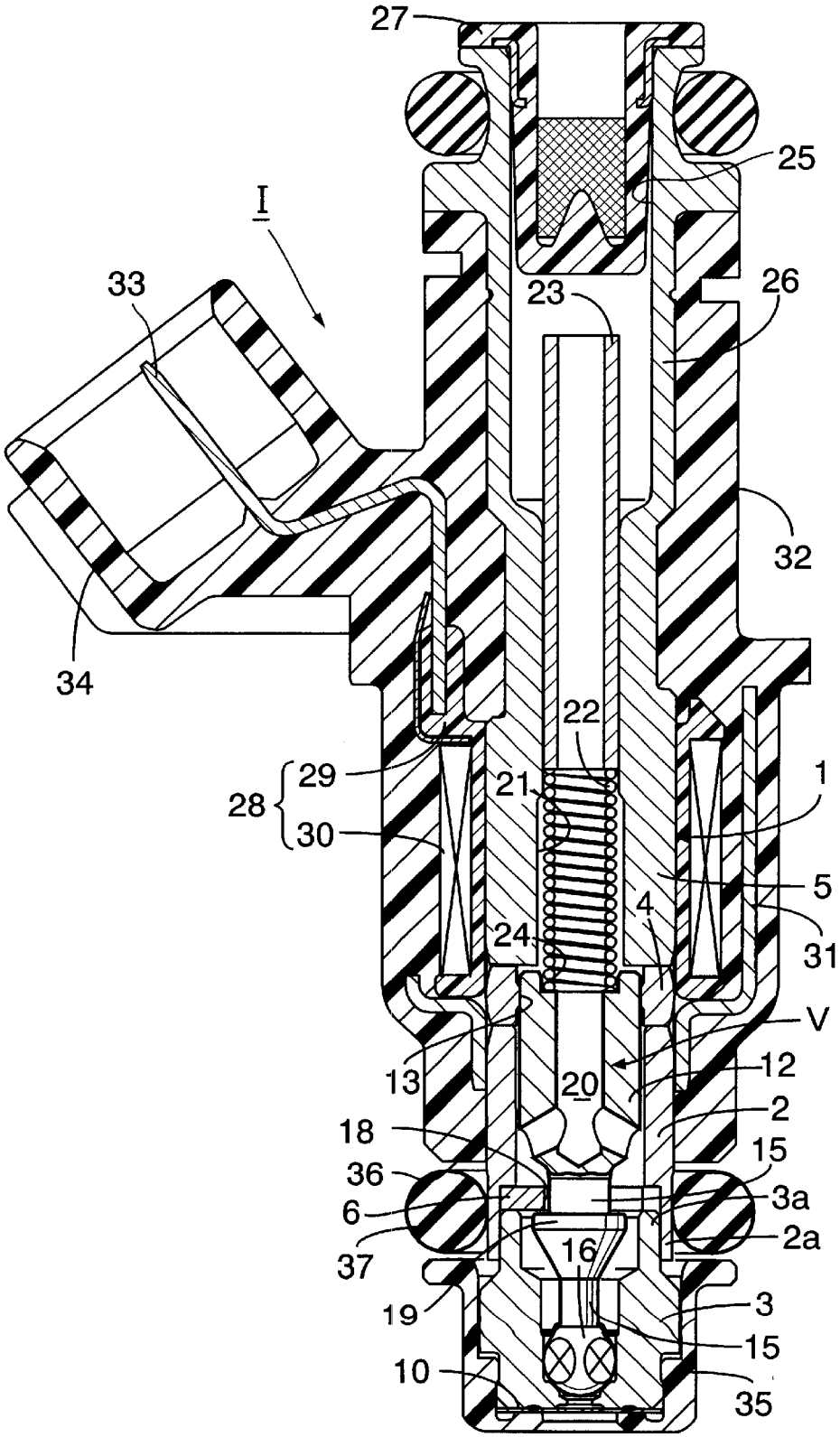
FIG. 3 is a vertical sectional view of the solenoid-type fuel injection valve.
Figure 4:
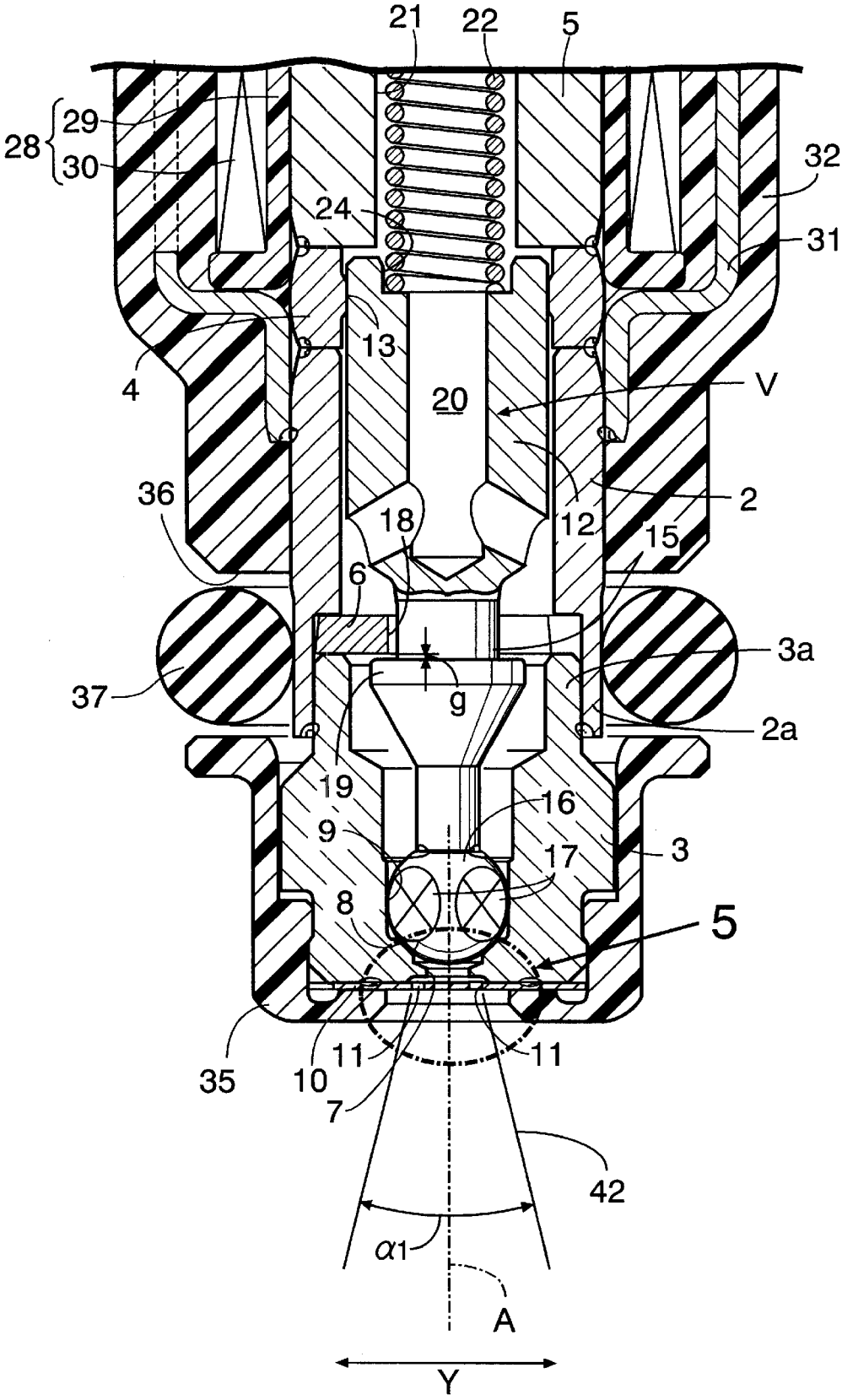
FIG. 4 is an enlarged view of an essential portion of the solenoid-type fuel injection valve shown in FIG. 3.
Figure 5:
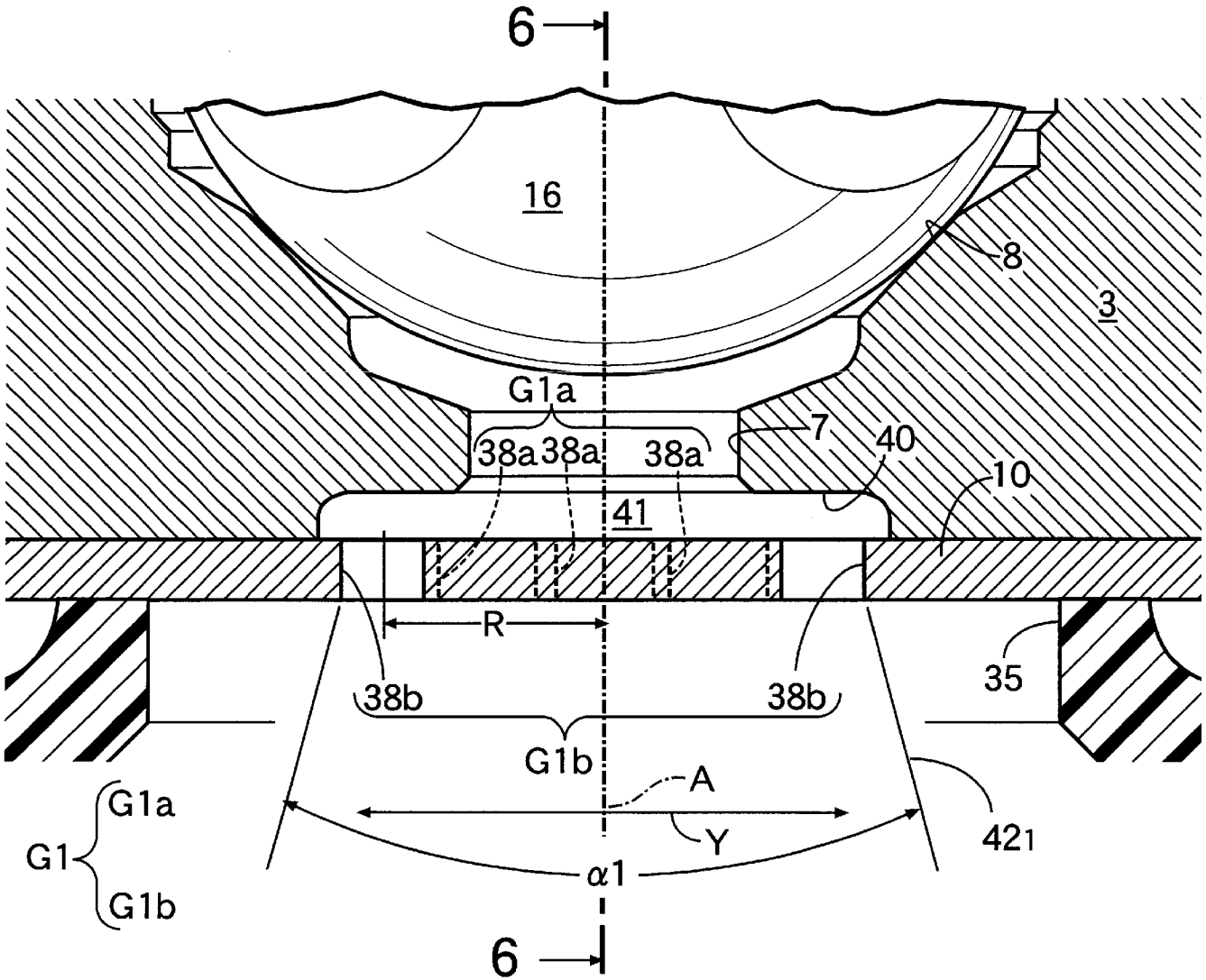
FIG. 5 is an enlarged view of a portion indicated by 5 in FIG. 4.

As shown in FIGS. 3 and 4, a casing 1 of the solenoid-type fuel injection valve I is comprised of a cylindrical valve housing 2 (made of a magnetic material), a bottomed cylindrical valve seat member 3 liquid-tightly coupled to a front end of the valve housing 2, and a cylindrical stationary core 5 liquid-tightly coupled to a rear end of the valve housing 2 with an annular spacer 4 interposed therebetween.

The annular spacer 4 is made of anon-magnetic metal, e.g., a stainless steel, and the valve housing 2 and the stationary core 5 are put against opposite ends of the annular spacer 4 and liquid-tightly welded over the entire periphery thereof to the annular spacer 4.

A first fitting tubular portion 3*a* and a second fitting tubular portion 2*a* are formed at opposed ends of the valve seat member 3 and the valve housing 2, respectively. The first fitting tubular portion 3*a* is press-fitted into the second fitting tubular portion 2*a* along with a stopper plate 6, which is clamped between the valve housing and the valve seat member 3. After fitting of the first and second fitting tubular portions 3*a* and 2*a*, laser beam welding is conducted over the entire periphery pf an annular corner exposed from the first fitting portion 2*a* and sandwiched between an outer peripheral surface of the first fitting tubular portion 3*a* and an end face of the second fitting tubular portion 2*a*, whereby the valve housing 2 and the valve seat member 3 are liquid-tightly coupled to each other.

The valve seat member 3 includes a valve bore 7 which opens into a front end face of the valve seat member 3, a conical valve seat 8 connected to an inner end of the valve bore 7, and a cylindrical guide bore 9 connected to a larger-diameter portion of the valve seat 8. The guide bore 9 is formed coaxially with the second fitting tubular portion 2*a*.

As shown in FIGS. 4 to 7, an injector plate 10 made of a steel plate is liquid-tightly welded over its entire periphery to the front end face of the valve seat member 3. A narrow recess 40 circular about the valve bore 7 is formed in a surface of the valve seat member 3 opposed to the injector plate 10 and constitutes a fuel diffusion chamber 41 between the valve seat member 3 and the injector plate 10. A plurality of, desirably, six to twelve fuel injection bores 38*a*, 38*b*, 39*a* and 39*b* are provided in the injector plate 10 and open into the fuel diffusion chamber 41, while surrounding an axis A of the valve bore 7.

The fuel injection bores 38*a*, 38*b*, 39*a* and 39*b* are classified into a primary group $G_1$ of the fuel injection bores 38*a* and 38*b* and a secondary group $G_2$ of the fuel injection bores 39*a* and 39*b*. The fuel injection bores 38*a* and 38*b* of the primary group $G_1$ are formed so that they are inclined to a side opposite from the axis A of the valve bore 7 only in the direction X toward a downstream side to inject the fuel toward the outlet of the primary intake port $Ep_1$, and the fuel injection bores 39*a* and 39*b* of the second group $G_2$ are formed so that they are inclined to a side opposite from the axis A of the valve bore 7 only in the direction X toward a downstream side to inject the fuel toward the outlet of the secondary intake port $Ep_2$.

The fuel injection bores 38*a* and 38*b* of the primary group $G_1$ are further subclassified into a primary inner group $G_1$a of fuel injection bores 38*a*, and a primary outer group $G_1$b of fuel injection bores 38*b* disposed on opposite sides of the fuel injection bores 38*a* of the primary inner group $G_1$a in the direction Y at locations where an axis distance between the fuel injection bore 38*b* and the valve bore 7 is smaller than that between the fuel injection bore 38*a* of the primary inner group $G_1$a and the valve bore 7. In this case, the fuel injection bore 38*b* of the primary outer group $G_1$b is formed at a diameter smaller than that of the fuel injection bore 38*b* of the primary inner group $G_1$a. The inclination angle of the fuel injection bore 38*b* of the primary outer group $G_1$b with respect to the axis A of the valve bore is set larger than that of the fuel injection bore 38*a* of the primary inner group $G_1$a with respect to the axis A of the valve bore. However, it is desirable that each of the inclination angles is set at 16° or less. This is for the purpose of avoiding it to the utmost that the primary fuel spray foam $\mathbf{42}_1$ formed by the fuel injected from the fuel injection bores 38*a* and 38*b* of the primary group G1 is brought into contact with an inner wall of the primary intake port $Ep_1$ opposite from the partition wall 43. It is desirable that a spacing $S_1$ is left in the direction Y between the adjacent fuel injection bores 38*a* and 38*b*. This is for the purpose of preventing it to the utmost that the fuels injected from the fuel injection bores 38*a* and 38*b* are joined together, resulting in coalescence of fuel particles.

The fuel injection bores 39*a* and 39*b* of the secondary group G2 are further subclassified into a secondary inner group $G_2$a of fuel injection bores 39*a*, and a secondary outer group $G_2$b of fuel injection bores 39*b* disposed on opposite sides of the fuel injection bores 39*a* of the secondary inner group $G_2$a in the direction Y at locations where an axis distance between the fuel injection bore 39*b* and the valve bore 7 is smaller than that between the fuel injection bore 39*a* of the secondary inner group $G_2$a and the valve bore 7. In this case, the fuel injection bore 39*b* of the secondary outer group $G_2$b is formed at a diameter smaller than that of the fuel injection bore 39*b* of the secondary inner group $G_2$a. The inclination angle of the fuel injection bore 39*b* of the secondary outer group $G_2$b with respect to the axis A of the valve bore is set larger than that of the fuel injection bore 39*a* of the secondary inner group $G_2$a with respect to the axis A of the valve bore. However, it is also desirable in this case for the same reason as that described above that each of the inclination angles is set at 16° or less. It is desirable for the same reason as that described above that a spacing $S_2$ is left in the direction Y between the adjacent fuel injection bores 39*a* and 39*b*.

If the minimum diameter of the fuel injection bores 38*a*, 38*b*, 39*a* and 39*b* of the primary and secondary groups $G_1$ and $G_2$ is represented by d, and the thickness of the injector plate 10 is represented by t, the thickness t and the minimum diameter d are set, so that $t/d<1$ is established.

The total of the cross-sectional areas of the fuel injection bores 38*a* and 38*b* of the primary group $G_1$ is set larger than that of the cross-sectional areas of the fuel injection bores 39*a* and 39*b* of the secondary group $G_2$.

Referring again to FIG. 3, a movable core 12 opposed to the front end face of the stationary core 5 is accommodated in the valve housing 2 and the annular spacer 4, and an annular guide face 13 is projectingly provided on an inner peripheral surface of the annular spacer 4 for carrying the movable core 12 for sliding movement in an axial direction.

The movable core 12 is integrally provided with a smaller-diameter rod 15 extending from one end face of the movable core 12 toward the valve seat 8, and a spherical valve portion 16 is secured by welding to a tip end of the rod 15 and capable of being seated on the valve seat 8. A valve stem V is constituted by the movable core 12, the rod 15 and the valve portion 16.

The valve portion 16 is carried in the guide bore 9 for sliding movement in the axial direction, and a plurality of chamfers 17 are formed in an arrangement at equal distances on an outer peripheral surface of the valve 16 to enable the flowing of the fuel within the guide bore 9.

The stopper plate 6 is provided with a notch 18 through which the rod 15 is passed, and a stopper flange 19 is formed at an intermediate portion of the rod 15 and opposed to an end face of the stopper plate 6 adjacent the valve seat 8. A gap g is provided between the stopper plate 6 and the stopper flange 19 to correspond to an opening stroke of the valve portion 16 provided when the valve portion 16 is closed, i.e., when the valve portion 16 is seated on the valve seat 8.

On the other hand, a gap is provided between the stationary core 5 and the movable core 12. This gap is of a size enough to avoid the abutment of the stationary and movable cores 5 and 12 against each other even when the valve portion 16 is closed, i.e., when the valve portion 16 is seated on the valve seat 8.

The stationary core 5 has a hollow 21 communicating with the inside of the valve housing 2 through a through-bore 20 in the movable core 12. Accommodated in the hollow 21 are a coil valve spring 22 for biasing the movable core 12 in a direction of closing of the valve portion 16, i.e., a direction of seating of the valve portion 16 on the valve seat 8, and a pipe-shaped retainer 23 for supporting a rear end of the valve spring 22.

In this case, a positioning recess 24 for receiving the front end of the valve spring 22 is defined in the rear end face of the movable core 12. The preset load of the valve spring 22 is adjusted by the depth of press-fitting of the retainer 23 into the hollow 21.

An inlet tube 26 is integrally connected to the rear end of the stationary core 5 and has a fuel inlet 25 communicating with the hollow 21 in the stationary core 5 through the pipe-shaped retainer 23, and a fuel filter 27 is mounted in the fuel inlet 25.

A coil assembly 28 is fitted over outer peripheries of the annular spacer 4 and the stationary core 5. The coil assembly 28 comprises a bobbin 29 fitted over the outer peripheries of the annular spacer 4 and the stationary core 5, and a coil 30 wound the bobbin 29. A coil housing 31 surrounding the coil assembly 28 is coupled at one end thereof to the outer peripheral surface of the valve housing 2.

The coil housing 31, the coil assembly 28 and the stationary core 5 are embedded in a sealed manner in a cover 32 made of a synthetic resin. A coupler 34 including a connecting terminal 33 connected to the coil 30 is integrally connected to an intermediate portion of the cover 32.

An annular groove 36 is defined between a front end face of the cover 32 and a cap 35 made of a synthetic resin and fitted over a front end of the valve seat member 3, and an O-ring 37 is mounted in the annular groove 36 to come into close contact with the outer peripheral surface of the valve housing 2. The O-ring 37 is adapted to come into close contact with an inner peripheral surface of a mounting bore in the intake manifold Em (see FIG. 1) upon mounting of the solenoid-type fuel injection valve I in the mounting bore.

The operation of the embodiment will be described below.

As shown in FIGS. 3 and 4, in a state in which the coil 30 has been deexited, the valve stem V is urged forwards by a biasing force of the valve spring 22, whereby the valve portion 16 is seated on the valve seat 8. Therefore, a high-pressure fuel supplied from a fuel pump (not shown) through the fuel filter 35 and the inlet tube 26 into the valve housing 1 is put on standby in the valve housing 1.

When the coil 30 is excited by supplying electric current to the coil 30, a magnetic flux produced thereby runs sequentially to the stationary core 5, the coil housing 31, the valve housing 2 and the movable core 12, and the movable core 12 is attracted to the stationary core 5 along with the valve portion 16 by a magnetic force, whereby the valve seat 8 is opened. Therefore, the high-pressure fuel in the valve housing 2 is transferred via the chamfers 17 of the valve portion 16 and through the valve bore 7 into the fuel diffusion chamber 41, where the high-pressure fuel is dispensed to all the fuel injection bores 38*a*, 38*b*, 39*a* and 39*b* of the primary and secondary groups $G_1$ and $G_2$, while being diffused to the periphery of the fuel diffusion chamber 41. Then, the fuel is injected from the fuel injection bores 38*a* and 38*b* of the primary group $G_1$ toward the outlet of the primary intake port $Ep_1$ in the internal combustion engine E and from the fuel injection bores 39*a* and 39*b* of the secondary group $G_2$ toward the outlet of the secondary intake port $Ep_2$ in the internal combustion engine E, whereby the primary and secondary spray foams $\mathbf{42}_1$ and $\mathbf{42}_2$ are formed by these fuel flows, as shown in FIGS. 1 and 2.

The spreading angles $\theta_1$ and $\theta_2$ of the primary and secondary spray foams $\mathbf{42}_1$ and $\mathbf{42}_2$ with respect to the axis A of the valve bore 7 are determined mainly by the axis distances R between the fuel injection bores 38*a* and 39*a* of the primary and secondary inner groups $G_1$a and $G_2$a and the valve bore 7, and the inclination angles of such fuel injection bores 38*a* and 39*a* with respect to the axis A. The spreading angles $\beta_1$ and $\beta_2$ of the primary and secondary spray foams $\mathbf{42}_1$ and $\mathbf{42}_2$ in the direction Y are determined mainly by the axis distances R between the fuel injection bores 38*a* and 39*a* of the primary and secondary inner groups $G_1$a and $G_2$a as well as between the fuel injection bores 38*a* and 39*a* of the primary and secondary outer groups $G_1$b and $G_2$b and the valve bore 7. Further, the spreading angles $\alpha_1$ and $\alpha_2$ of the primary and secondary spray foams $\mathbf{42}_1$ and $\mathbf{42}_2$ in the direction Y are determined by the axis distances R between the fuel injection bores 38*b* and 39*b* of the primary and secondary inner groups $G_1$b and $G_2$b located on the outermost side in the direction Y and the valve bore 7.

In this case, in the primary and secondary groups $G_1$ and $G_2$, the fuel injection bores 38*a*, 38*b*, 39*a*, 39*b* are spaced apart from each other in the directions X and Y and hence, the fuel flows injected from the fuel injection bores 38*a*, 38*b*, 39*a*, 39*b* are less joined together, whereby the atomization of the injected fuel can be maintained. Namely, it is possible to prevent the coalescence of the fuel particles.

The fuel injection bores 38*b* and 39*b* of each of the outer groups $G_1$b and $G_2$b are formed at a diameter smaller than that of the fuel injection bores 38*b* and 39*b* of the corresponding inner groups $G_1$a, $G_2$a, and has the relatively large inclination angles with respect to the axis A of the valve bore 7. Therefore, the fuel injected from each of the fuel injection bores 38*a*, 38*b*, 39*a* and 39*b* is directed away from the partition wall 43 between the primary and secondary intake ports $Ep_1$ and $Ep_2$, and is spread at the tip end to a smaller extent. Therefore, the spreading angles $\alpha_1$ and $\alpha_2$ of the primary and secondary spray foams $\mathbf{42}_1$ and $\mathbf{42}_2$ in the direction Y can be defined distinctly, thereby preventing the deposition of the injected fuel to the partition wall 43 to the utmost.

Figure 8:
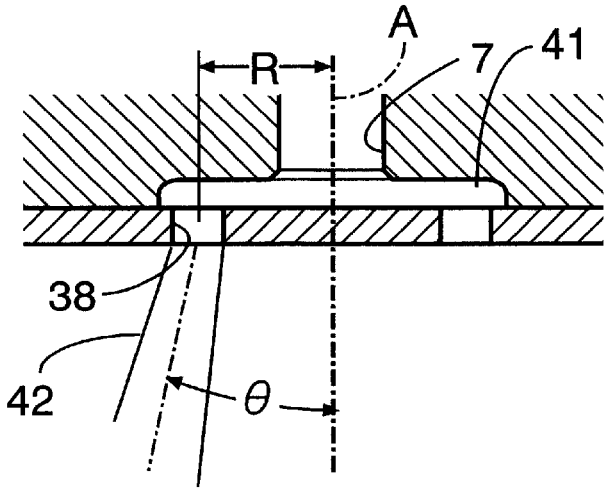
FIG. 8 is a diagram showing the relationship between the axis distance R between a valve bore and a fuel injection bore and the spreading angle θ of a fuel spray foam with respect to an axis of the valve bore.
Figure 8:
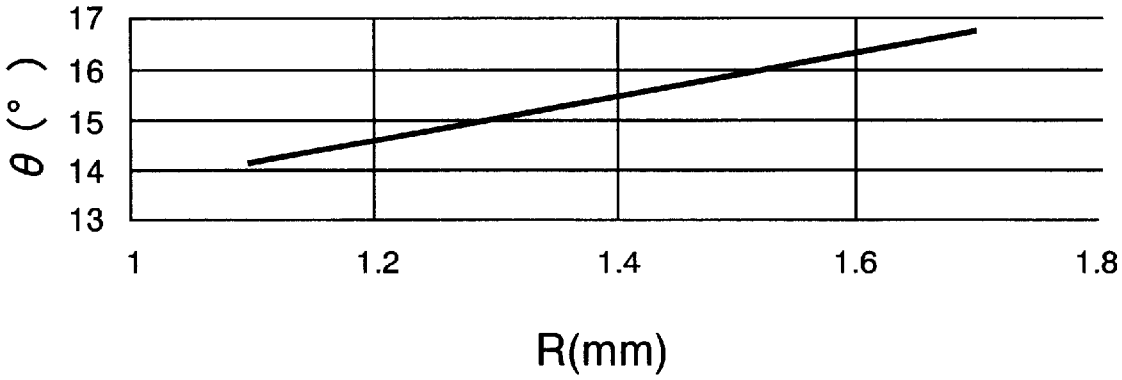
Figure 1:
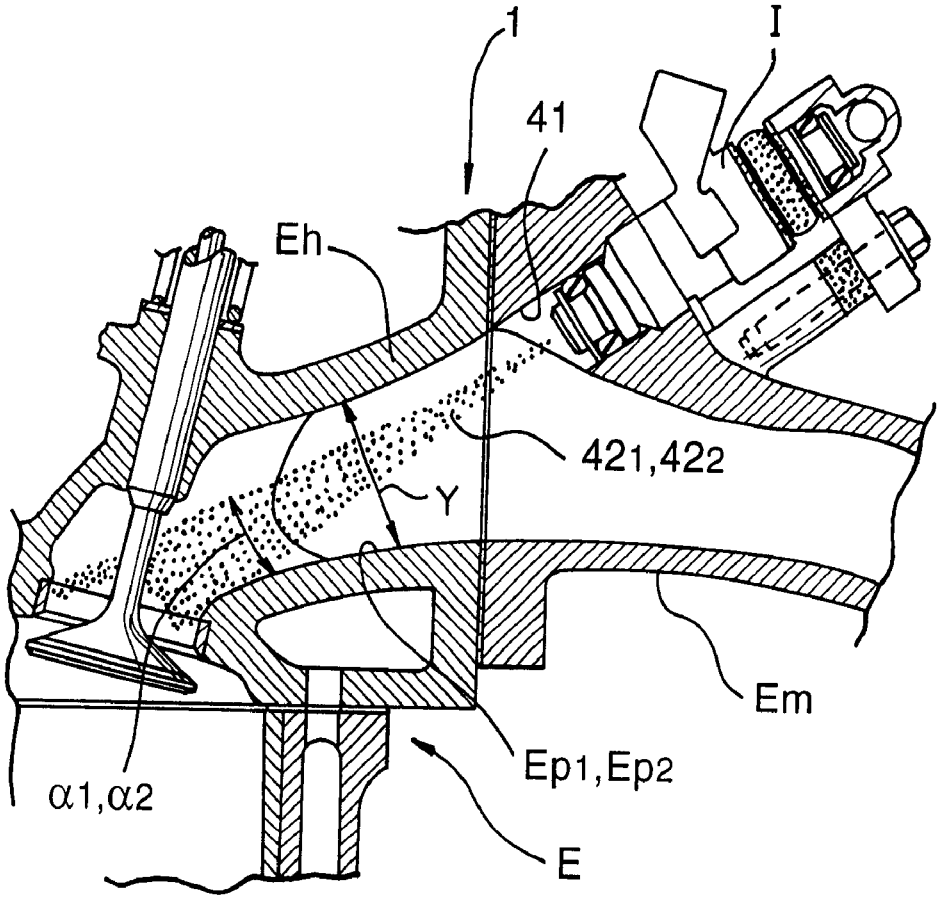
Figure 6:
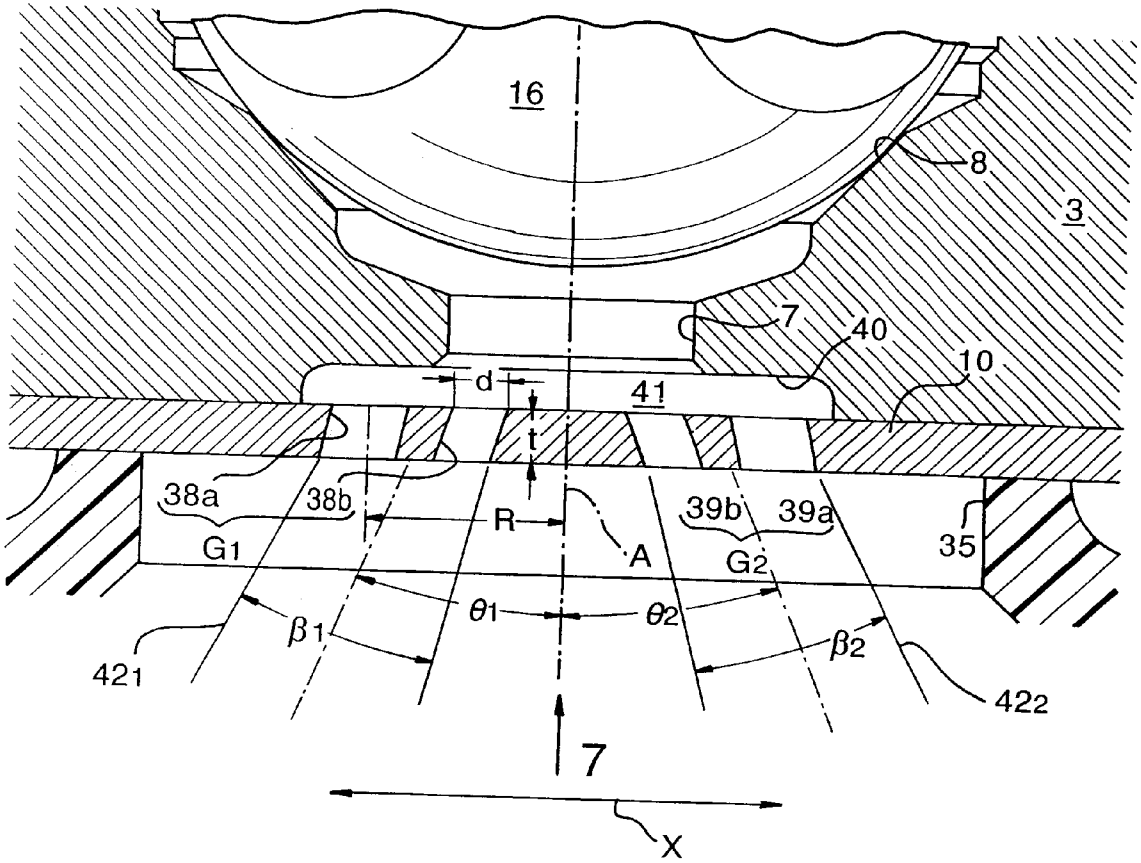
Figure 7:
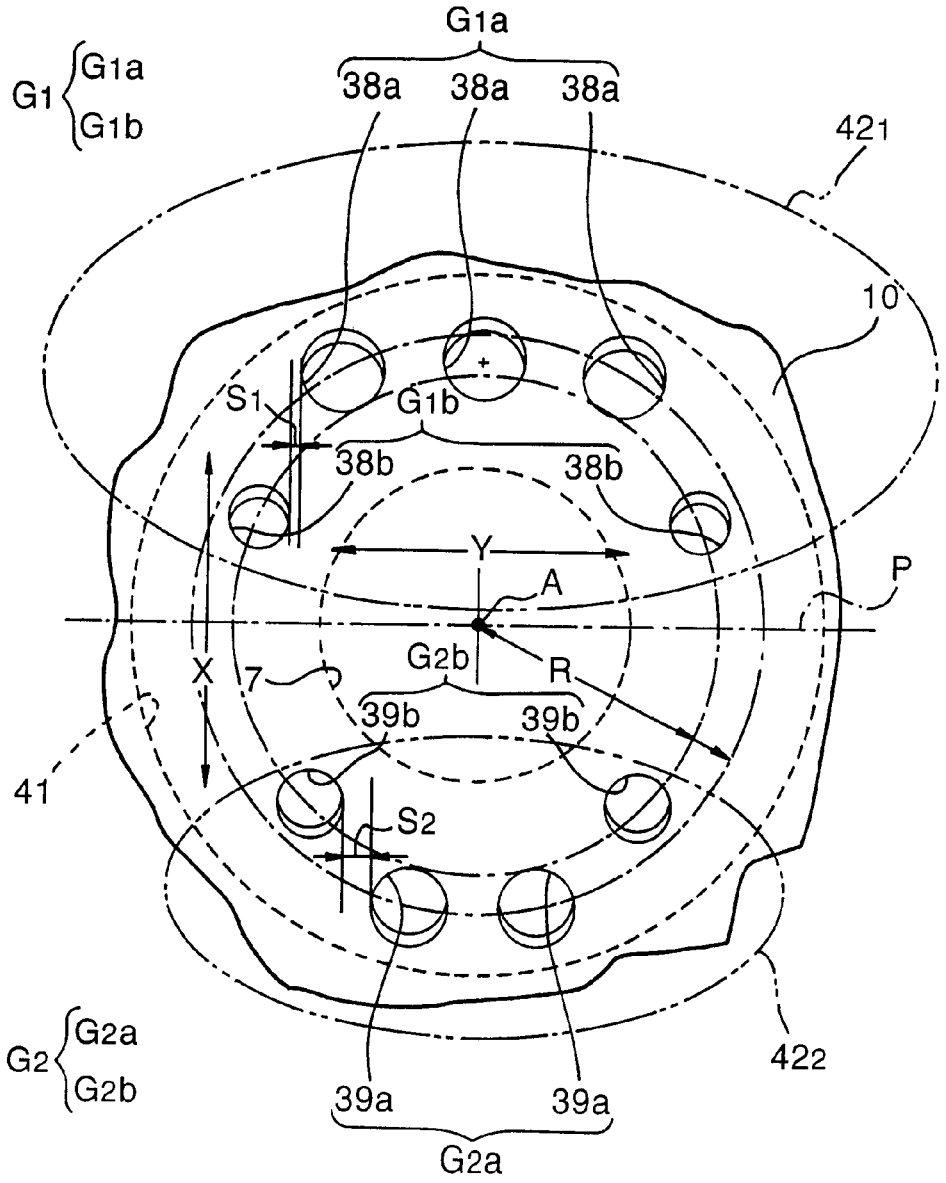

Although the high-pressure fuel passed from the valve bore 7 into the fuel diffusion chamber 41 is diffused in the chamber 41, the vector of the high-pressure fuel flow passed through each of the fuel injection bores 38*a*, 38*b*, 39*a* and 39*b* has a radial component about the valve bore and an axial component. Particularly, the radial component is larger as the axis distance R between the valve bore 7 and each of the injection bores 38*a*, 38*b*, 39*a* and 39*b* is larger. As a result, the spreading angle θ of the injection foam 42 formed by the fuel injected from the fuel injection bore 38 with respect to the axis A of the valve bore 7 is increased with an increase in axis distance R between the valve bore 7 and the injection bore 38, as shown in FIG. 8. This has been confirmed by a test. The present invention has been accomplished based on the result of this test, and thus, the fuel injection bores 38*a*, 38*b*, 39*a* and 39*b* of the primary and secondary groups $G_1$ and $G_2$ are angled only in the direction X to provide the spreading angles $\theta_1$ and $\theta_2$ of the primary and secondary spray fuel foams $\mathbf{42}_1$ and $\mathbf{42}_2$ with respect to the axis A of the valve bore 7, and the spreading angles of the primary and secondary other fuel spray foams $\mathbf{42}_1$ and $\mathbf{42}_2$ in the directions X and Y are set depending on the magnitude of the axis distances R between the fuel injection bores 38*a*, 38*b*, 39*a* and 39*b*. Namely, the angle of inclination of each of the fuel injection bores 38*a*, 38*b*, 39*a* and 39*b* with respect to the axis A of the valve bore 7 is zero in the direction Y.

Therefore, the fuel injection bores 38*a*, 38*b*, 39*a* and 39*b* can be formed easily at a desired angle in the injector plate 10 by pressing or by a drilling only by inclining the injector plate 10 and a tool relative to each other in the direction Y, leading to a substantially enhanced productivity.

In addition, the thickness t of the injector plate 10 and the minimum diameter d of the fuel injection bores 38*a*, 38*b*, 39*a* and 39*b* is set in a relation, $t/d<1$ and hence, the atomization of the fuel injected from each of the fuel injection bores 38*a*, 38*b*, 39*a* and 39*b* can be promoted, while reducing the function of restricting the direction of the fuel injected from each of the fuel injection bores 38*a*, 38*b*, 39*a* and 39*b*. The reduction of the function of restricting the direction of the fuel injected from each of the fuel injection bores 38*a*, 38*b*, 39*a* and 39*b* provides an advantage that the spreading angles $\theta_1$ and $\theta_2$ of the fuel spray foams $\mathbf{42}_1$ and $42_2$ with respect to the axis A of the valve bore 7 can be set properly depending on the axis distances R between the valve bore 7 and the fuel injection bores 38*a*, 38*b*, 39*a* and 39*b*.

Thus, it is possible to easily form the primary and secondary fuel spray foams $42_1$ and $42_2$ suitable to be supplied to the primary and secondary intake ports $Ep_1$ and $Ep_2$ of the internal combustion engine E, while facilitating the formation of the fuel injection bores 38*a*, 38*b*, 39*a* and 39*b*, and at the same time, the atomization of the injected fuel can be promoted.

The total of the cross-sectional areas of the fuel injection bores 38*a* and 38*b* of the primary group $G_1$ is set larger than that of the fuel injection bores 39*a* and 39*b* of the secondary group $G_2$ and hence, the amount of fuel injected from the fuel injection bores 38*a* and 38*b* of the primary group $G_1$ is larger than the amount of fuel injected from the fuel injection bores 39*a* and 39*b* of the secondary group $G_2$. Thus, in the internal combustion engine E, it is possible to exhibit a fuel-dispensing characteristic suitable for the low-speed operational state in which the amount of gas drawn in the primary intake port $Ep_1$ is larger than that in the secondary intake port $Ep_2$. This can contributes to an enhancement, particularly, in performance of the low-speed operation of a higher use frequency.

The number of and the diameters of the fuel injection bores 38*a*, 38*b*, 39*a* and 39*b* of the primary and secondary groups $G_1$ and $G_2$ can be selected as desired. The diameters of both the fuel injection bores 38*b* and 39*b* of the primary and secondary outer groups $G_1$b and $G_2$b have been set smaller than those of the fuel injection bores 38*a* and 39*a* of the corresponding inner groups $G_1$a and $G_2$a in the embodiment, but the diameter of only one of the fuel injection bores 38*b* and 39*b* of the primary and secondary outer groups $G_1$b and $G_2$b may be set smaller than that of the fuel injection bore 38*a* or 39*a* of the corresponding inner group $G_1$a, $G_2$a.

Although the embodiments of the present invention have been described in detail, it will be understood that the present invention is not limited to the above-described embodiment, and various modifications in design may be made without departing from the spirit and scope of the invention defined in claims.

What is claimed is:

1. A solenoid-type fuel injection valve comprising:

a valve seat member having a valve seat and a valve bore provided through a center portion of said valve seat;

a valve stem for opening and closing said valve bore by cooperation with said valve seat;

an injector plate coupled to an outer end face of said valve seat member and having a plurality of fuel injection bores disposed around an axis of said valve bore; and a fuel diffusion chamber which is defined between said valve seat member and said injector plate so as to have a diameter larger than that of said valve bore and which is faced by said valve bore and all of said fuel injection bores, said plurality of fuel injection bores being all located radially outside of said valve bore and being parted on a plane including the axis of said valve bore into a primary group of fuel injection bores and a secondary group of fuel injection bores for injecting fuel toward a pair of primary and secondary intake ports, respectively, wherein the fuel injection bores of the primary group are formed so that they are inclined to a side opposite and away from the axis of said valve bore only in a direction X toward a downstream side, and the fuel injection bores of the secondary group are formed so that they are inclined to a side opposite and away from the axis of said valve bore only in said direction X toward the downstream side, wherein said direction X represents a direction of arrangement of said primary and secondary ports in the internal combustion engine, and a direction Y represents a direction perpendicular to said direction of arrangement, and wherein the fuel injection bores of the primary group are sub-classified into a primary inner group of fuel injection bores, and a primary outer group of fuel injection bores disposed on opposite sides of the fuel injection bores of the primary inner group in the direction Y at locations where an axis distance between the fuel injection bore of the primary outer group and said valve bore is smaller than that between the fuel injection bore of the primary inner group and said valve bore, and the fuel injection bores of the secondary group are sub-classified into a secondary inner group of fuel injection bores, and a secondary outer group of fuel injection bores disposed on opposite sides of the fuel injection bores of the secondary inner group in the direction Y at locations where an axis distance between the fuel injection bore of the secondary outer group and said valve bore is smaller than that between the fuel injection bore of the secondary inner group and said valve bore.

2. A fuel injection bore according to claim 1, wherein the fuel injection bores of at least one of said primary outer group and secondary outer group are formed at a diameter smaller than that of the fuel injection bores of the corresponding inner group.

3. A fuel injection valve according to claim 1 or 2, wherein the total of cross-sectional areas of the fuel injection bores of said primary inner group and said primary outer group are set larger than that of cross-sectional areas of the fuel injection bores of said secondary inner group and said secondary outer group.

4. A fuel injection valve according to claim 1 or 2, wherein the relationship between the thickness t of said injector plate and the minimum diameter d of the fuel injection bores of said primary and secondary groups is set at $t/d<1$.

* * * * *

UNITED STATES PATENT AND TRADEMARK OFFICE

CERTIFICATE OF CORRECTION

PATENT NO. : 6,616,071 B2
DATED : September 9, 2003
INVENTOR(S) : Koji Kitamura et al.

Figure 6:
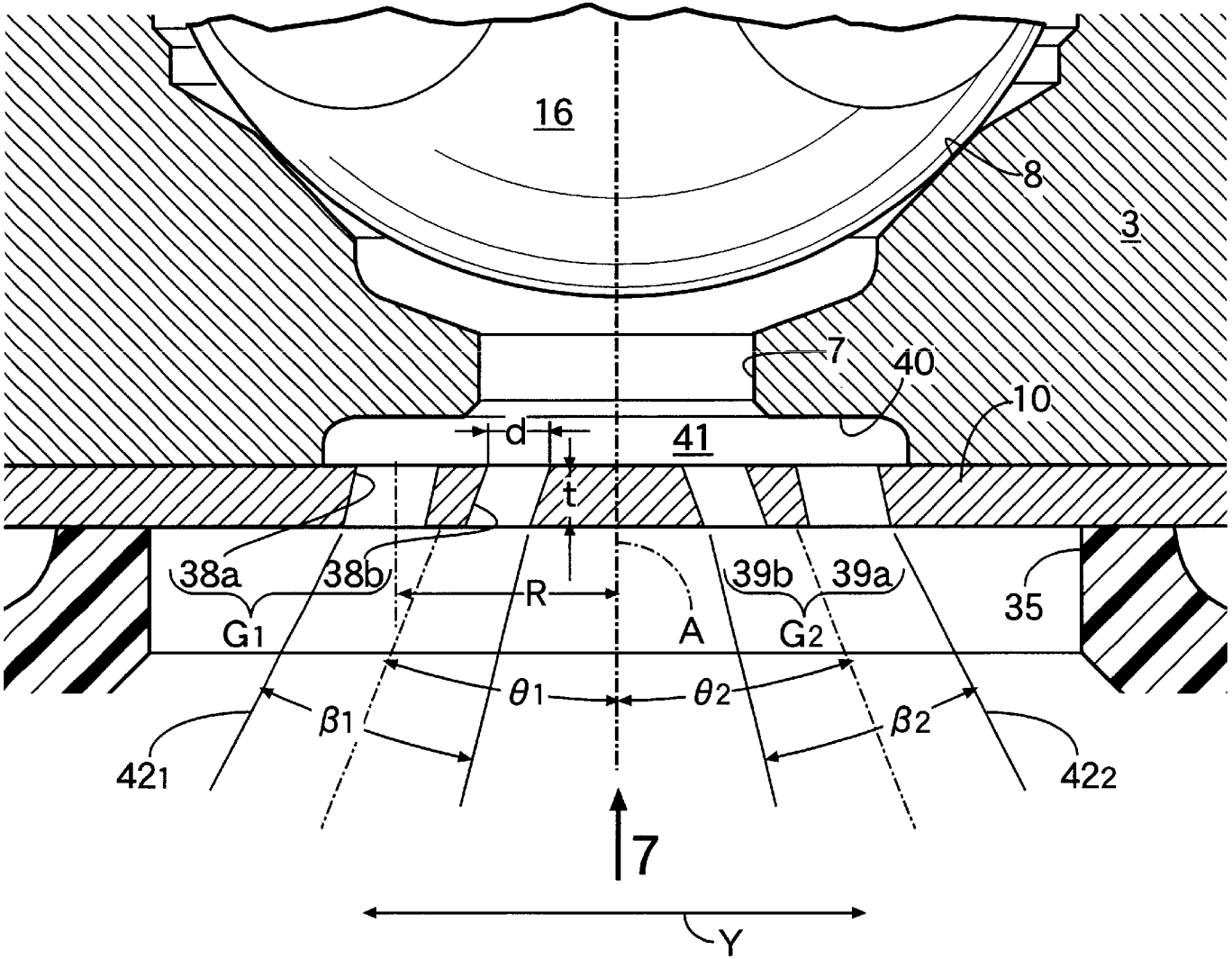
FIG. 6 is a sectional view taken along a line 6—6 in FIG. 5.
Figure 7:
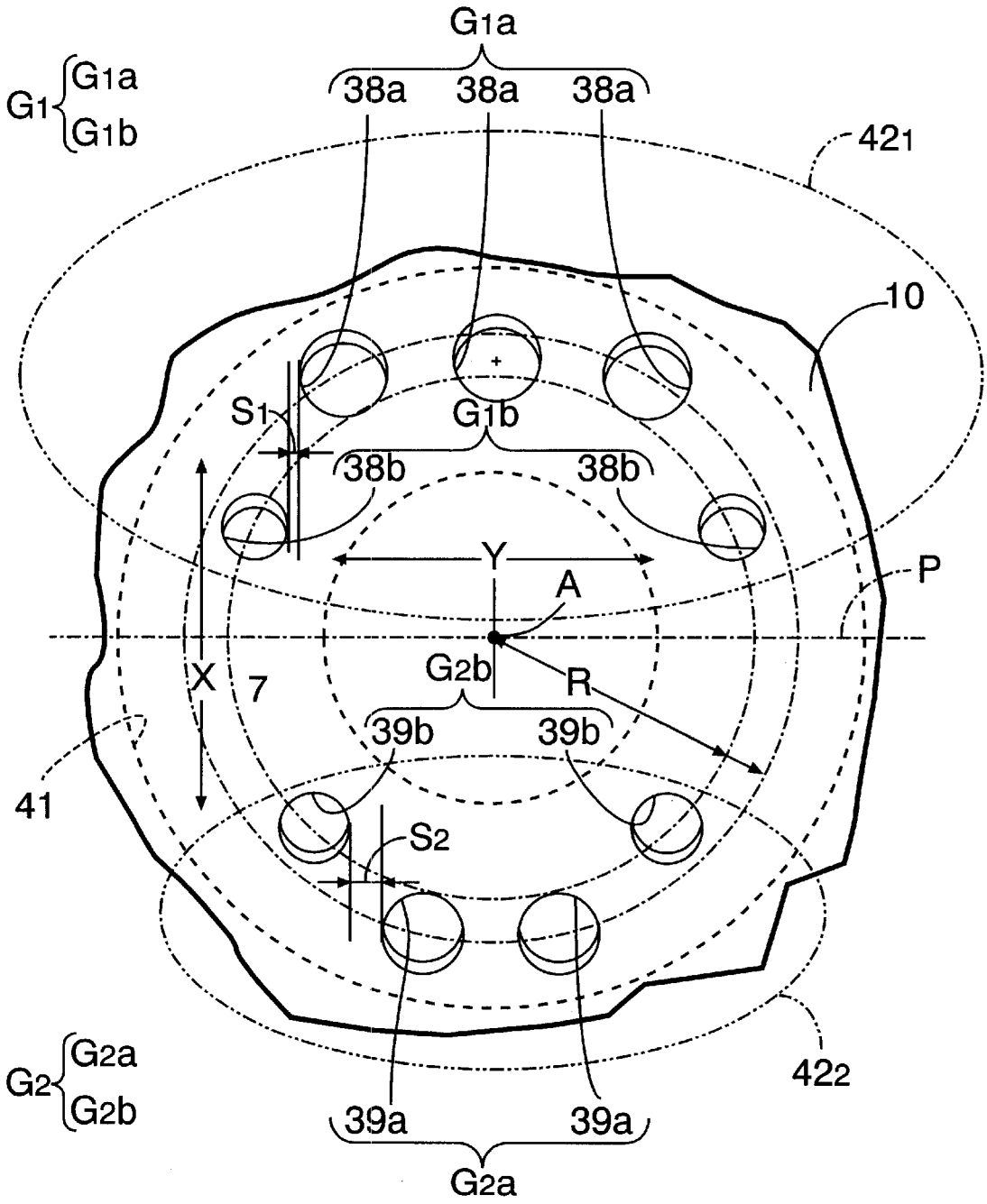
FIG. 7 is a view taken in a direction of an arrow in FIG. 6.

It is certified that error appears in the above-identified patent and that said Letters Patent is hereby corrected as shown below:

Drawings,
Please delete original Figures 1, 6 and 7 and substitute therefor attached new Figures 1, 6 and 7.

Signed and Sealed this

Thirteenth Day of April, 2004

JON W. DUDAS
*Acting Director of the United States Patent and Trademark Office*